United States Patent [19]

Thomas

[11] Patent Number: 4,598,901

[45] Date of Patent: Jul. 8, 1986

[54] SHINGLING AND STACKING OF CONVEYED SHEET MATERIAL WITH PRE-SHINGLING CONTROL OF SHEET FEED

[75] Inventor: Richard H. Thomas, Phillips, Wis.

[73] Assignee: Marquip, Inc., Phillips, Wis.

[21] Appl. No.: 664,353

[22] Filed: Oct. 24, 1984

[51] Int. Cl.[4] ..... B65H 29/66

[52] U.S. Cl. ..... 271/202; 271/151; 271/183; 271/270

[58] Field of Search ..... 271/202, 203, 183, 182, 271/270, 150, 151

[56] References Cited

U.S. PATENT DOCUMENTS 2,819,079 1/1958 Beaulieu ..... 271/202

4,200,276 4/1980 Marschke ..... 271/202 X

FOREIGN PATENT DOCUMENTS 1179453 10/1964 Fed. Rep. of Germany ..... 271/202

*Primary Examiner*—Richard A. Schacher

*Attorney, Agent, or Firm*—Andrus, Sceales, Starke & Sawall

[57] ABSTRACT

A conveyor system wherein sheets (10) are conveyed from a cutter (9) or the like at a given speed, are increased in speed before passing through a vacuum conveyor shingling section (5), are slowed down at the shingling section and then normally proceed at the slowed-down speed to a stacker (8) which is adapted to stack a fixed number of sheets before discharging a stack. The sheets are basically handled in accordance with the device disclosed in U.S. Pat. No. 4,200,276. To prevent scattering of the sheets during shingling due to high input conveyor speeds and the like, the vacuum conveyor shingling section (5) includes a second (or pre-shingling) conveyor (38) upstream of the original shingling conveyor (15). The pre-shingling conveyor operates at a relatively high rate of speed while the original shingling conveyor operates at a relatively low rate of speed (which nevertheless may be as high as the device of the patent) relative to the sheet input speed. A setting control (40) is provided to pre-set the pre-shingler conveyor speed in correlation with the input speed of the sheets and the length of the individual sheets. The pre-set pre-shingler conveyor speed remains constant during operation of the device. Conveyors (15, 6, 7) downstream of the pre-shingling conveyor (38) run at speeds which are correlated to the speed of the supplemental pre-shingling conveyor (38).

7 Claims, 11 Drawing Figures

SHINGLING AND STACKING OF CONVEYED SHEET MATERIAL WITH PRE-SHINGLING CONTROL OF SHEET FEED

U.S. PRIOR ART OF INTEREST

| U.S. Pat. No. | Inventor | Issue Date |
|---|---|---|
| 4,200,276 | Marschke | April 29, 1980 |

BACKGROUND AND SUMMARY OF THE INVENTION

This invention relates to shingling and stacking of conveyed sheet material with the incorporation of a system for controlling sheet feed. The invention is an improvement over the above-identified U.S. Pat. No. 4,200,276, the entire contents of which is incorporated herein by reference.

In U.S. Pat. No. 4,200,276, hereinafter referred to as the prior patent, sheets of corrugated paperboard or the like are cut and fed in line in succession from an input (corrugator) conveyor section, through a speed-up conveyor section and hence to a vacuum conveyor section where the sheets are shingled. The shingled sheets are then fed through an accumulating conveyor section and a stack infeed conveyor section to a sheet stacker. The patent discloses numerous controls, including a system control circuit (FIG. 8) for controlling variable speed conveyor motors and other apparatus. The motors, including a shingling conveyor motor, are initially pre-set for a "normal" speed, and, except for the speed-up conveyor motor, are then varied from normal by the controls in response to movement of the sheets along the device.

Basically, the speed-up conveyor of the patented device increases the speed of the corrugated sheets over the speed at the input conveyor section during the entire operation. The normal pre-set speed of the other conveyors downstream of the speed-up conveyor is usually substantially less than that of the input conveyor, and generally the same for all downstream conveyors.

In operation of the patented device, the downstream conveyors are all speeded up to a generally similar speed, during which time the sheets are shingled into stacks which are ultimately separated. The conveyors are then individually and successively slowed in a downstream direction to cause separate shingled stacks to pull away from each other. Once a shingled stack has been fully discharged into the stacker, the downstream conveyors are returned to normal speed. The process repeats itself for each group of sheets, depending upon how many sheets the stacker can handle at one time.

Heretofore, the pre-set normal speed of the vacuum shingling conveyor (and other downstream conveyors) has been substantially lower than the input speed, such as 25% thereof. At moderate sheet input speeds (such as 500 ft./min.) and long individual sheet lengths (such as 200 inches), no essential problems have arisen with the vacuum shingling conveyor. However, it has been noted that as sheet input speeds are increased (such as to 1,000 ft./min.) and/or individual sheets are shortened (such as to 30 inches), optimum shingling has not taken place; that is, the sheets have not formed into a neat stack but have skewed and slid in a longitudinal direction in an overrunning action.

It is believed that the problem of "scattered" shingles is due to the reduction in the size of the tail on each successive sheet being shingled due to the abrupt change of sheet speed as it enters the shingler, accompanied especially by relatively high overall speeds. The vacuum box on the shingler cannot firmly hold high speed and/or small tail sheets in place. Merely increasing the pre-set normal speed of the vacuum shingling conveyor (and other downstream conveyors) to, for example, 50% of the input speed to solve the problem, may overrun the capacity of the stacking device because sheets will be delivered to it faster.

It is an aim of the invention to substantially reduce or eliminate the problem of shingle scattering at the vacuum conveying section. It is a further aim of the invention to solve the problem, even with high input speeds and small sheet tails. It is yet another aim to solve the problem without overrunning the capacity of the sheet stacking device.

In accordance with the various aspects of the invention, the shingling section of the device of U.S. Pat. No. 4,200,276 is provided with a combination of the usual vacuum shingler together with a pre-shingling means such as a second shingler disposed just upstream of the usual or first shingler. The second shingler is disposed at the discharge of the speed-up conveyor. A setting control is provided to pre-set the pre-shingler conveyor speed in correlation with the input conveyor speed and the length of individual sheets. The pre-set pre-shingling conveyor speed remains constant during operation of the device and is set at a speed higher than the normal pre-set speed of the first or usual vacuum shingling conveyor, which is controlled, as before, by the system circuit.

The higher speed of the auxiliary or pre-shingling vacuum conveyor provides for less of a shock to the sheets (given the same input sheet speed) than a lower speed would and may be calculated to prevent scattered shingles. At the same time, the first or main shingling conveyor, being set at a lower speed than that of the second or pre-shingling conveyor, receives and re-shingles the sheets and passes them on down the line, with the other downstream conveyors functioning exactly as in the prior patent. The result is that the stacker may receive the same number of sheets per unit of time as without the pre-shingling device, but the shingled stacks are no longer skewed or the like.

Since the first vacuum shingling conveyor and the second or vacuum pre-shingling conveyor are both dependent on the input conveyor speed, the first conveyor is correlated with and bears a known relationship to the second conveyor. Thus, the first conveyor and the conveyors downstream thereof travel at a speed during operation which is effectively a percentage of the second conveyor speed.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1A:
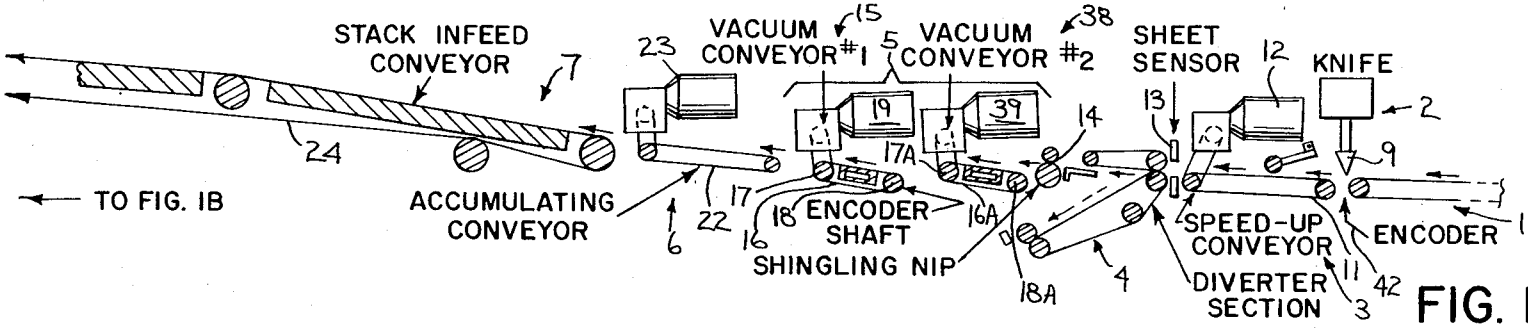
FIGS. 1A and 1B are schematic in-line views of a device adapted to operate in accordance with the various aspects of the invention.
Figure 1B:
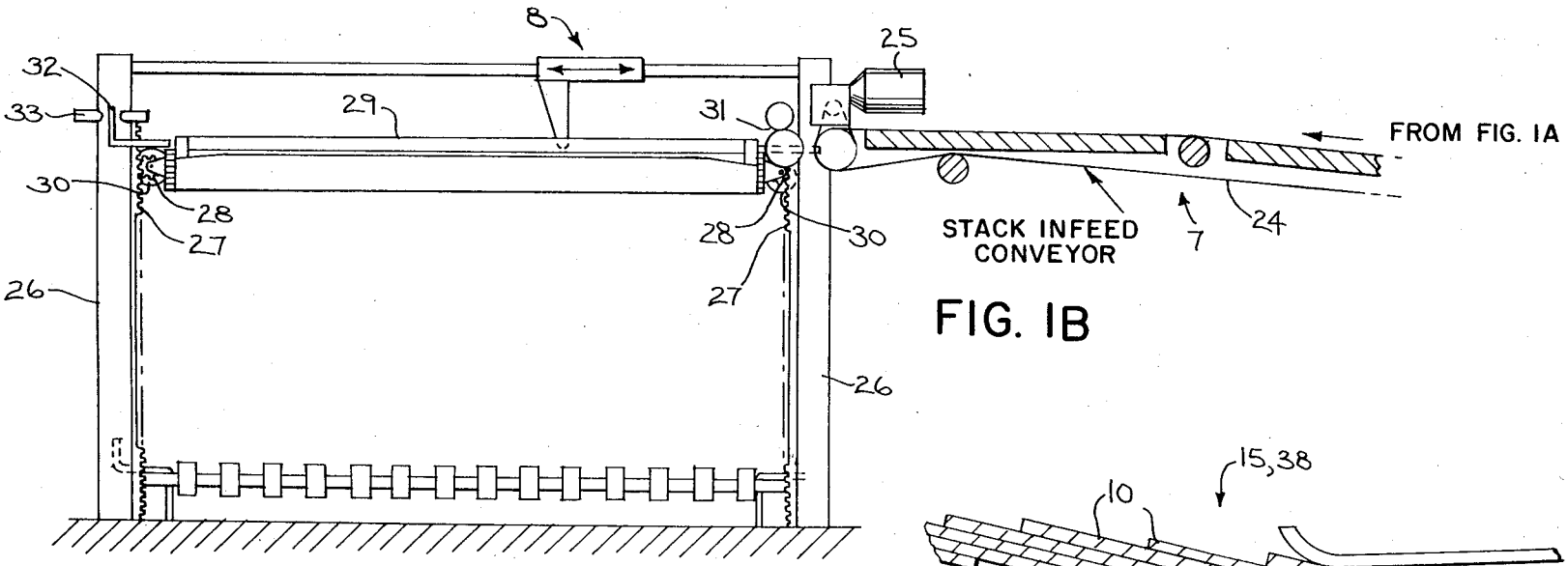
Figure 2:
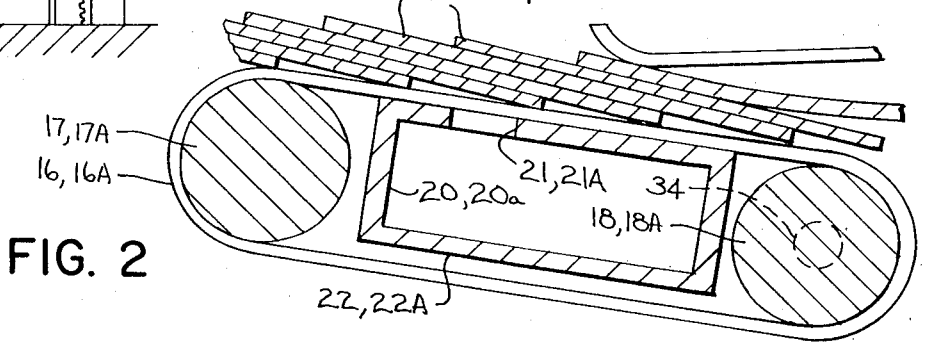
FIG. 2 is an enlarged sectional view representing the construction of both vacuum shingling conveyors and their respective shingling mechanisms.

As best shown in FIGS. 1A, 1B and 2, the concept of the invention may be embodied in a device which includes, in line, an input conveyor section 1, a paperboard cutting section 2, a speed-up conveyor section 3, a diverter section 4, a vacuum conveyor section 5, an accumulating conveyor section 6, a stack infeed conveyor section 7 and a sheet stacker 8.

Input conveyor section 1 feeds a continuous web of traveling material past cutting section 2 which includes a knife 9 for severing the material into separate individual sheets 10. Conveyor section 1 is normally driven at a constant speed. Knife 9 may be controlled in any suitable well known way which is correlated with the input speed to provide a given number of cuts of a given length per unit of time.

Speed-up conveyor section 3 includes an endless belt 11 which is suitably driven by a motor 12 and which receives sheets from the knife 9 for further transfer to section 4. It is desirable to separate sheets 10 from their abutting relationship so that they are suitable spaced apart for further handling downstream. For this purpose, motor 12 is designed to drive belt 11 at a speed faster than the input conveyor to thereby pull the sheets apart and provide a space therebetween. In the embodiment shown, belt 11 is adapted to be driven at about 110% of the speed of input conveyor section 1.

A sheet sensor 13, such as a photoelectric device is disposed at the discharge end of speed-up section 3.

Diverter section 4 is fully described in the prior patent and further description thereof is not deemed necessary here.

Sheets 10 which are not diverted pass through a pair of rollers which form a shingling nip 14 and onto vacuum conveyor section 5.

Section 5 includes a first or usual vacuum shingler 15 which includes a plurality of side-by-side endless belts 16 trained about front and rear shafts 17, 18 respectively, and with a motor 19 adapted to drive the belts through shaft 17. See also FIG. 2. A transversely elongated vacuum box 20 is disposed between the upper and lower flights of belts 16, is connected to any suitable source of negative pressure, not shown, and has opening means 21 in its upper wall to apply a vacuum or negative pressure to sheets 10 which descend thereupon.

Motor 19 is adapted at all times to be driven at a substantially slower speed than motor 12 so that belts 16 will travel slower than belt 11. This slower speed of the first vacuum shingler 15, together with the vacuum, decelerates the oncoming sheets 10, as will be described more fully hereinafter.

During normal operation, the shingled sheets then pass onwardly to accumulating conveyor section 6 which includes an endless belt 22 which is suitably driven by a motor 23 which normally drives the belt at the same speed as belts 16 are driven. The sheets then pass onwardly to stack infeed conveyor section 7 which also comprises an endless belt 24 suitably driven at the same speed by a motor 25. Thus, normally, the shingled sheets pass from vacuum conveyor section 5 through sections 6 and 7 at the same reduced speed until they finally reach sheet stacker 8.

As best seen in FIG. 1B, stacker 8 includes a pair of vertical frame members 26 having racks 27 thereon. Racks 27 in turn mesh with pinions 28 mounted on a roller-type stacker platform 29 and which are adapted to be driven by individually connected motors 30 to move the platform vertically within the frame. A nip 31 is disposed at the entrance to stacker 8 and through which the shingled sheets pass.

One end of the stacker platform 29 is provided with a finger 32 which, when the platform raises to the top, actuates a lift sensor 33 of photocell or other suitable type for purposes described in the prior patent.

The raising and lowering of stacker platform 29 and the receipt and discharge of sheets 10 therefrom are described in detail in the prior patent.

Also, as described in the prior patent, rear shaft 18 of first vacuum shingler 15 is provided with an encoder 34 wherein a pulse creating member is mounted to the shaft and pulses the encoder upon each shaft revolution.

Figure 3:
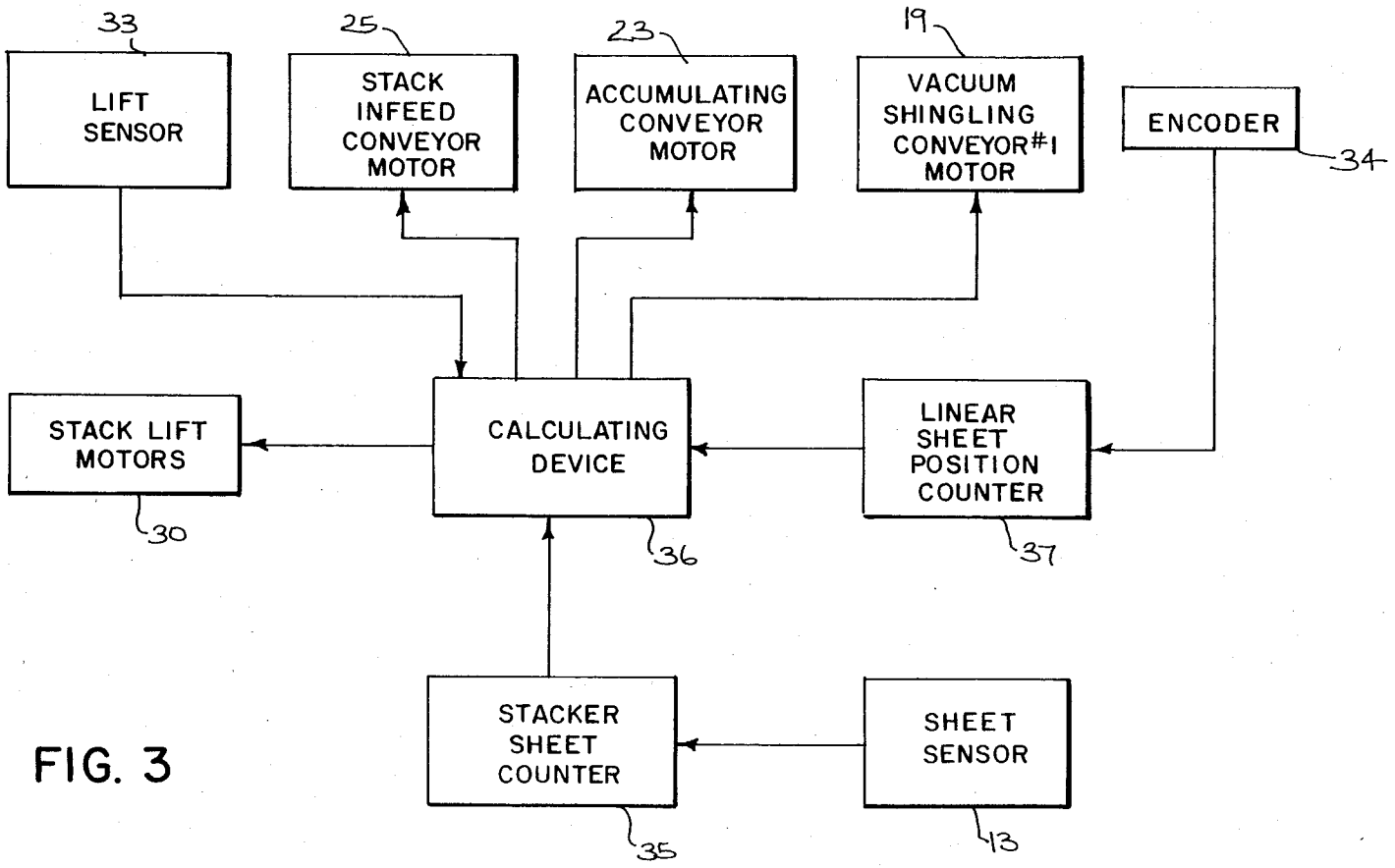
FIG. 3 is a diagrammatic view of the overall system control circuit correlated with the first vacuum shingling conveyor.

Referring to FIG. 3, a diagrammatic showing of the overall system control circuit is disclosed. Sheet sensor 13 is connected to the input of a stacker sheet counter 35 which is set to provide a signal to a suitable calculating and motor actuating device 36 when a pre-set number of sheets have passed upstream of vacuum conveyor section 5. If 100 sheets are to be provided in each separate stack, the said signal will be given to the calculating device 36 when the net number of sheets (those passing sensor 13 less those passing through diverter section 4) equals 100.

In addition, encoder 34 is connected to a linear sheet position counter 37 which is connected through device 36 to motors 19, 23, 25 and 30, which are of the variable speed type. Since all of the conveyors bear a known positional relationship with each other and with the encoder shaft 18, it is possible to know, via the counter 37, exactly where the trailing edge of the last sheet of a batch of 100 is located relative to the conveyors. This is determined through calculating device 36.

Lift sensor 33 is also connected to stack lift motors 30 for determining the upper limit of travel of platform 29.

The device, as described above is substantially similar in structure and operation as that disclosed in the prior patent. See especially FIGS. 9–14 of that patent and related description of the cycle. As noted therein, the motors for the vacuum conveyor section, the accumulating conveyor section and the stack infeed conveyor section are initially pre-set for a normal speed (Patent FIG. 10) and are then varied from normal by the overall system control circuit (Patent FIG. 8). This normal speed is less than that of the input or "corrugator" conveyor and is based on a percentage of the input conveyor speed. The vacuum conveyor, accumulating conveyor and stack infeed conveyor are then all speeded up and the sheets are shingled, and the operation continued as heretofore generally described herein and as described in more detail in the prior patent.

As also previously described herein, under certain circumstances such as very high speed input conveyor operation and/or short sheet lengths, the results of shingling by the single shinger often became unacceptable. This was especially true if the ratio of input speed (such as 1,000 ft./min.) and normal speed of the vacuum shingler (such as 250 ft./min.) was especially high (such as 4 to 1). The shingler could not handle the shock of high speed input to it of short-tailed sheets, resulting in scattering of the sheets as by skewing or otherwise sliding.

To prevent this problem from occurring, pre-shingling means are provided in vacuum conveyor section 5 between the discharge of the sheet input conveyor 1 and vacuum shingling conveyor 15. See FIG. 1A. In the present embodiment, and referring to FIGS. 1A and 2, the pre-shingling means comprises a second or supplemental vacuum shingler 38. Shingler 38 is shown as being identical to that shown in FIG. 2, so that like parts are designated by alternate reference numerals 16A, 17A, 18A, 20A and 21A, with the drive motor therefor being designated as 39 in FIG. 1A.

For purposes of operating second shingler 38, means are provided to pre-set the speed of motor 39 to a fixed speed correlated with the speed of the incoming sheets 10 and the length of the individual sheets. For this purpose, and in the present embodiment, a setting control circuit 40 (FIG. 4) is provided. The circuit includes an input conveyor speed sensing device 41 which may sense the conveyor speed at input section 1, such as by an encoder 42 of a type similar to encoder 34. The circuit further includes a device 43 to sense the length of each severed sheet. Device 43 may be of any suitable well-known type which senses the actual length of individual sheets or which alternately correlates the knife cutting frequency with the speed of sheet movement as possibly determined by encoder 42.

The outputs of sheet speed sensing device 41 and sheet length sensing device 43 are fed to a calculating device 44 of any well-known type which suitably correlates the information received and feeds it to pre-shingler motor 39 to provide a desired set sheet speed for pre-shingler 38, said speed remaining constant throughout the entire machine cycle.

The speed inputed to the second vacuum conveyor motor 39 is determined by calculator 44 such that the length of exposed vacuum on the vacuum conveyor remains essentially constant and independent of changes in input speed and sheet length. The equation for the vacuum conveyor speed is: vacuum conveyor speed equals the input conveyor speed divided by the sheet length times a constant.

The pre-set fixed speed of conveyor 16A of the second vacuum shingler 38 is determined to always be at a lower ratio to the speed of input conveyor 1 than was the vacuum shingler of the prior patent. For example, with input conveyor speed at 1,000 ft./min. and pre-shingling speed at 500 ft./min., the ratio would be 2 to 1 instead of the previously described 4 to 1. Thus, the slowdown of inputting sheets for shingling is much less severe and scattering is reduced or eliminated.

By the same token, the pre-set normal speed of first shingler 15 is always set to be less than the speed of pre-shingler 38, although it varies during the machine cycle.

The speeds of first shingler 15 and second shingler 38 are clearly dependent on the speed of input conveyor 1, with shingler 15 having a variable speed during the cycle as opposed to the fixed speed of shingler 38. In other words, first shingler 15 has a variable speed relation to conveyor 1, while second shingler 38 bears a fixed relation thereto. Therefore, the normal and changing speed of first shingler 15 can be said to be correlated to the fixed speed of second shingler 38 at all times, in terms of percentages.

OPERATION

Figures 4, 5, 6, 7:
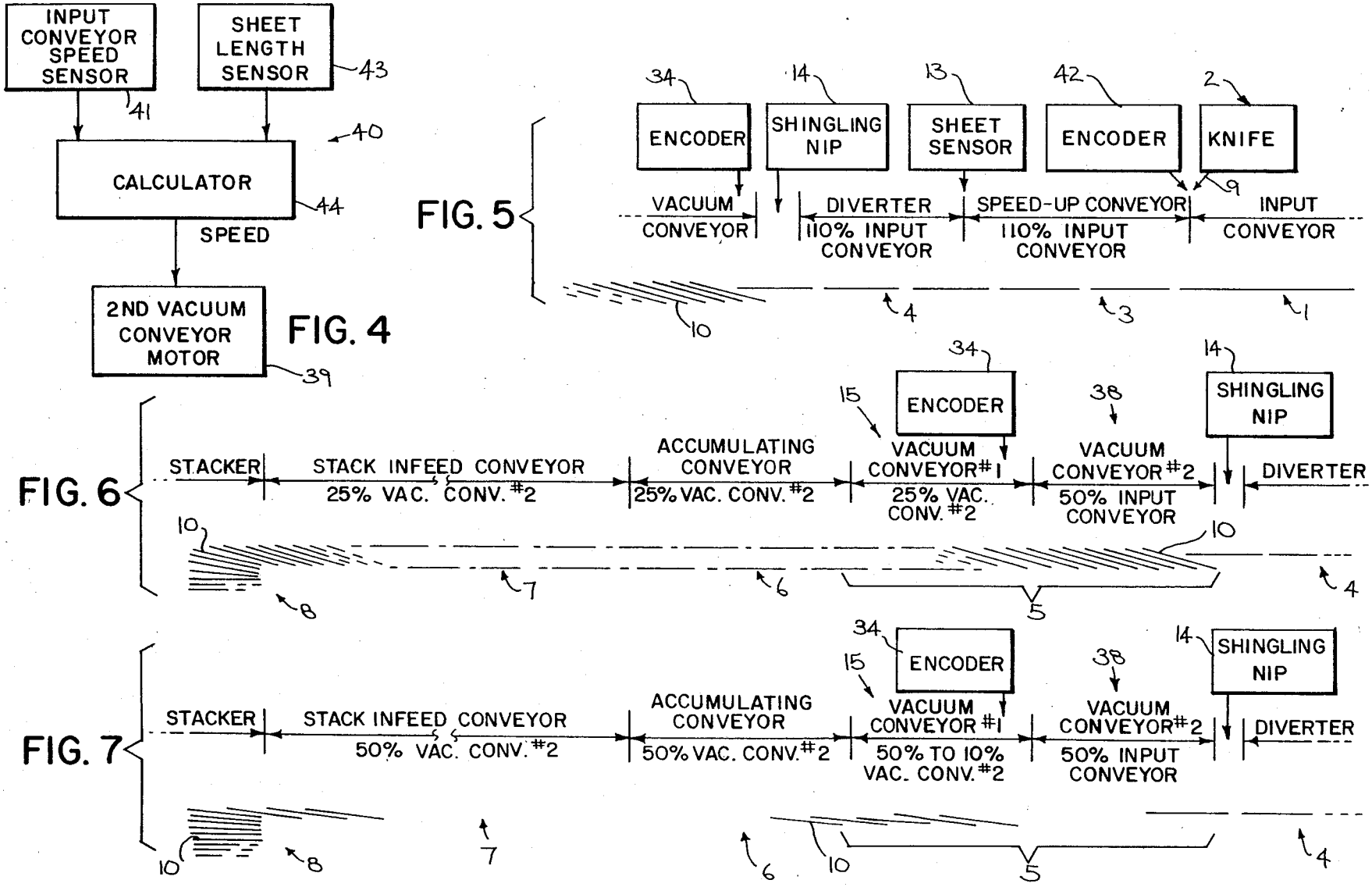
FIG. 4 is a diagrammatic view of the setting control circuit for the second or vacuum pre-shingling conveyor.
FIG. 5 is a schematic side elevation of the upstream portion of the conveyor line and showing the sheet positions and movement through the various upstream sections.
FIG. 6 is a schematic side elevation of the downstream portion of the conveyor line and showing the sheet positions and movement through the various downstream sections during the normal portion of the shingling and stacking run.
FIG. 7 is a view similar to FIG. 6 during the first phase after the stack discharge cycle is initiated.

FIG. 6 illustrates the normal conveying of sheets 10 to form a stack at stacker section 8. The percentages shown are illustrative only, within the parameters of the above discussion, but provide for ready comparison with the corresponding FIG. 10 of the prior patent. During this normal condition, cut sheets 10 are fed from conveyor 11, through shingling nip 14 to the second vacuum shingler 38 where they are pre-shingled into a discrete stack of shingled sheets. Second shingler 38 is pre-set, as by setting control circuit 40, to continuously run at a speed calculated by calculator 44, said speed typically being 50% of conveyor 1. This 50% slowdown of the sheets is in many instances adequate to prevent scattering at input speeds of 1,000 ft./min. or more. As shown, the normal pre-set speed of first vacuum shingler 15 is 25% of second shingler 38 or effectively ⅛ of the speed of input conveyor 1. The pre-slowdown caused by shingler 38 is such that the further slowdown by re-shingler 15 in its re-shingling operation will not cause sheet scattering problems as the pre-shingled stack of sheets pass from second shingler 38 to first shingler 15. As shown, in FIG. 6, the normal speeds of first shingler 15, accumulating conveyor 6 and stack infeed conveyor 7 are all the same—in this instance all being 25% of second shingler 38.

As described in the prior patent, sheet counter 35 is set to provide a cycle starting signal when the requisite selected number of sheets 10 has been counted. When this happens, the machine is triggered to go through the basic cycle of the prior patent.

Figures 8, 9, 10:
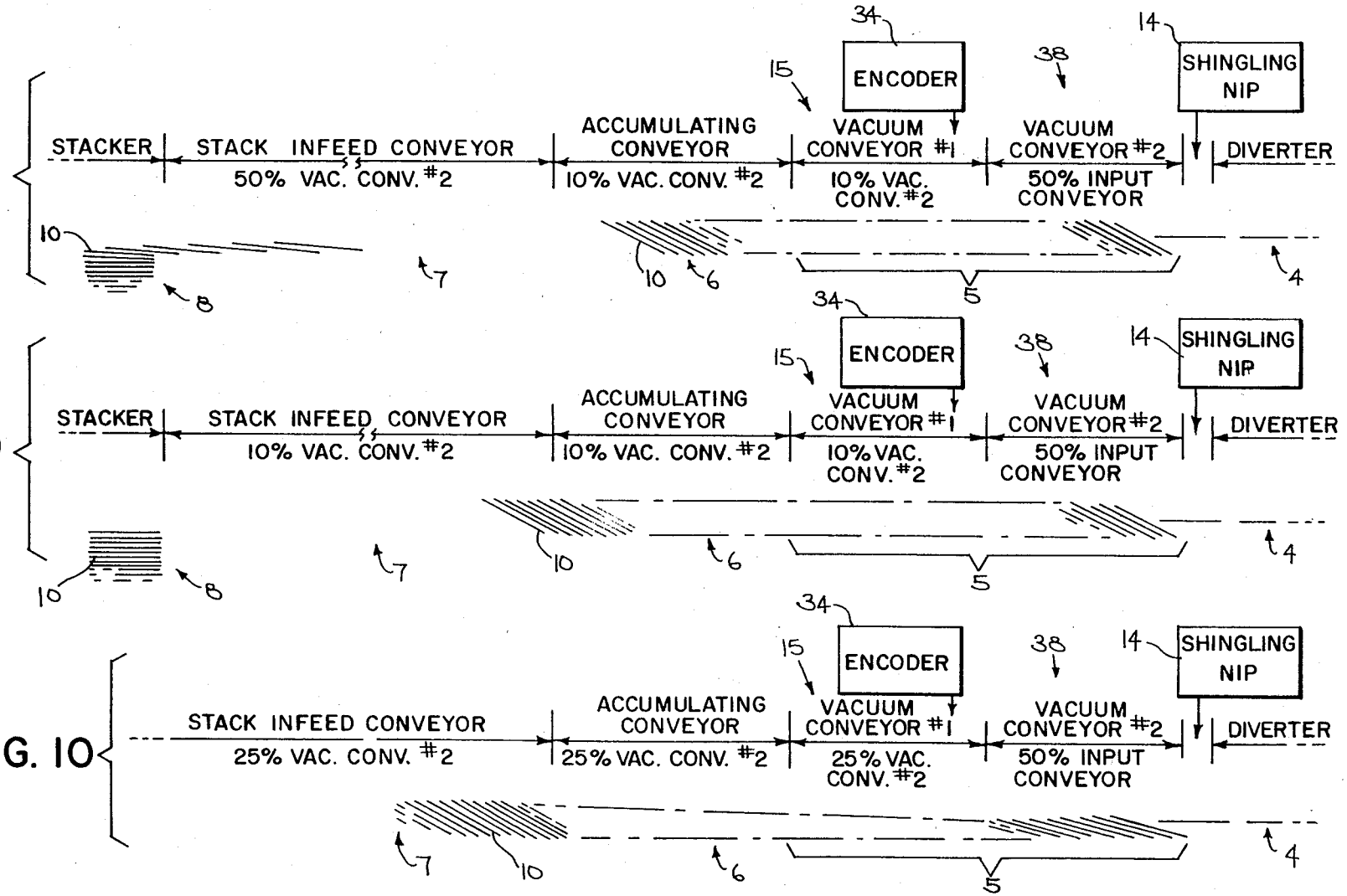
FIG. 8 is a view similar to FIGS. 6 and 7 during subsequent continuation of the discharge cycle.
FIG. 9 is a view similar to FIGS. 6–8 when a stack has been completed for discharge.
FIG. 10 is a view similar to FIGS. 6–9 at the start-up of conveying the next stack in succession.

Briefly, and as to FIG. 7, the speeds of elements 15, 6 and 7 are all increased (such as to 50% of the speed of second shingler 38) which changes the amount of overlap of the shingled stack and pulls the downstream shingled stack away from the unshingled upstream sheets. As to FIGS. 7 and 8, as the upstream edge of a stack clears vacuum section 5, calculator device 36 slows down first shingler 15, such as to 10% of the speed of second shingler 38. Similarly, when the upstream stack edge clears accumulator conveyor 6, the speed of the latter will also be reduced, such as to 10% of the speed of second shingler 38. As shown in FIG. 9, when the upstream stack edge clears stack infeed conveyor 7, the same thing happens.

The conveyor slowdown is therefor in a downstream direction, one-by-one in succession.

As to FIG. 10, when the shingled stack upstream edge has cleared infeed belt 24, devices 34, 37 and 36 cause stacker motors 30 to lower platform 35 for sheet discharge, and calculating device 36 causes motors 19, 23 and 25 to accelerate back up to normal speed. The cycle then begins again.

Various types of well-known sensing devices, counters, calculators and motor actuators, and the interconnections therefor, could be utilized without departing from the spirit of the invention which provides an improved concept for shingling and stacking of conveyed sheet material.

Various modes of carrying out the invention are contemplated as being within the scope of the following claims particularly pointing out and distinctly claiming the subject matter which is regarded as to the invention.

I claim:

1. In the method of conveying sheets in succession from a first location along a plurality of separate in-line conveyors to a stacker wherein a stack of a predetermined number of sheets is to be formed, and wherein said sheets are first slowed and shingled into groups at a shingling location, the groups of shingled sheets are increased in speed, and the said conveyors are then individually slowed in a downstream direction, the step of: shingling the said sheets in multiple stages at said shingling location so that a multi-stage slowdown of said sheets occurs, said shingling step including:

(a) pre-shingling said sheets at a speed less than the speed of the sheets at said first location, (b) and then re-shingling said pre-shingled sheets at a speed less than the speed of said pre-shingling, (c) said pre-shingling step being performed at a fixed speed, (d) and said re-shingling step being performed at a variable speed correlated to the fixed speed of said pre-shingling step.

2. The method of claim 1 which includes the steps of:

(a) cutting said sheets to a desired length from a traveling web of material upstream of said first location, (b) and setting the speed of sheets during said pre-shingling step in accordance with the speed of said sheets at said first location and with the length of said cut sheets.

3. In a device for conveying sheets in succession from a first location along a plurality of separate in-line conveyors to a stacker wherein a stack of a predetermined number of sheets is to be formed and which includes a shingling location for slowing and shingling said sheets into groups, and which includes means to increase the speed of the shingled sheets and wherein the conveyors are positioned and controlled to individually slow in a downstream direction, the improvement comprising: means to shingle said sheets in multiple stages at said shingling location so that a multi-stage slowdown of said sheets occurs and with said shingling means comprising:

(a) means to pre-shingle said sheets at a speed less than the speed of the sheets at said first location, (b) and means to then re-shingle said pre-shingled sheets at a speed less than the speed of the sheets traveling through said pre-shingling means, (c) said pre-shingling means including means to pre-shingle said sheets at a fixed speed, (d) and said re-shingling means including means to re-shingle said sheets at a variable speed which is correlated to said fixed speed.

4. The device of claim 3 which includes:

(a) cutting means disposed upstream of said first location to cut said sheets to a desired length from a traveling web of material, (b) and means to set the speed of said sheets traveling through said pre-shingling means in accordance with the speed of said sheets at said first location and with the length of said cut sheets.

5. The device of claim 3 wherein:

(a) said pre-shingling means includes a pre-shingling vacuum conveyor having a first drive means, (b) and said re-shingling means includes a re-shingling vacuum conveyor having a second drive means.

6. The device of claim 5 which includes: a setting control means connected to said first drive means with said control means being responsive to the speed of said sheets at said first location and to the length of said sheets.

7. The device of claim 6 which includes: a further control means connected to said second drive means for varying the speed of said sheets at said re-shingling vacuum conveyor.

* * * * *